United States Patent [19]

Filz

[11] Patent Number: 4,839,138

[45] Date of Patent: Jun. 13, 1989

[54] PROCESS OF MAKING A SINTERED MOLDING

[75] Inventor: Friedrich Filz, Laakirchen, Austria

[73] Assignee: Miba Sintermetall Aktiengesellschaft, Laakirchen, Austria

[21] Appl. No.: 166,112

[22] Filed: Mar. 10, 1988

[30] Foreign Application Priority Data

Mar. 16, 1987 [AT] Austria ..... A 613/87

[51] Int. Cl.[4] ..... G22F 7/00

[52] U.S. Cl. ..... 419/6; 419/38; 419/44

[58] Field of Search ..... 419/5, 44, 6, 38, 7, 419/8, 9

[56] References Cited

U.S. PATENT DOCUMENTS 2,399,773 5/1946 Waintrob ..... 419/6
3,373,003 3/1968 Schreiner ..... 419/6

FOREIGN PATENT DOCUMENTS 3305879 8/1984 Fed. Rep. of Germany .
2822902 11/1984 Fed. Rep. of Germany .

*Primary Examiner*—Stephen J. Lechert, Jr.
*Attorney, Agent, or Firm*—Kurt Kelman

[57] ABSTRACT

To make a sintered molding which is provided with at least one molybdenum containing wear-resisting facing (2), a low-alloy iron powder (10) which is intended to form the base of the molding and a carbon-free metal powder mixture (3) which is intended to form the wear-resisting facing (2) and consists of unalloyed iron particles and unalloyed molybdenum particles are jointly molded in a common mold (9) to form a molding, which is subsequently sintered.

In order to prevent a mixing of the two metal powder layers, the metal powder which is intended to form the wear-resisting facing (2) is separately compacted to form a compact (5) before the mold (9) is charged with the iron powder (10) that is intended to form the base of the molding.

7 Claims, 2 Drawing Sheets

PROCESS OF MAKING A SINTERED MOLDING

BACKGROUND OF THE INVENTION

1. Field of the Invention

This invention relates to a process of making a sintered molding provided with at least one molybdenum-containing wear-resisting facing, wherein a low-alloy iron powder which is intended to form the base of the molding and a carbon-free metal powder mixture which is intended to form the wear-resisting facing and consists of unalloyed iron particles and unalloyed molybdenum particles are jointly molded in a common mold to form a molding, which is subsequently sintered.

2. Description of the Prior Art

Rocker arms for transmitting motion from a camshaft to a valve, e.g., in an internal combustion engine, have an end face which cooperates with a cam and is subjected to high stresses, which result in a considerable wear. For this reason that surface of the rocker arm which is intended to cooperate with a cam should be provided with a facing which has a high resistance to wear under the loads to be expected and consists of a meterial which is a good match with the material of the camshaft.

German Pat. No. 2,822,902 discloses a simple and inexpensive process of making valve tappets which have a wear-resisting facing, which particularly distinguishes by having a high resistance to wear under sliding friction. In that process said wear-resisting facing is made from a carbon-free powder mixture of unalloyed iron particles and unalloyed molybdenum particles, which mixture is sintered at a relatively high temperature up to 1350° C. For that purpose the metal powder for making the wear-resisting facing and subsequently a low-alloy iron powder for forming the base of the molding are changed into a common mold in which they are jointly molded to form a molding, which is subsequently sintered. But that joint molding may result in a mixing of the two metal powder layers at their interface so that the low-alloy iron powder may enter the layer which is intended to form the wear-resisting facing and the resistance of that facing to wear will thus be reduced. Besides, the joint molding of the two metal powder layers cannot always be controlled to ensure that the wear-resisting facing will have a predetermined thickness. Moreover, the conditions of internal friction in the two metal powder layers are different so that the joint molding will not necessarily result in a compaction of the two powder layers to a unuform density.

In the making of composite moldings by a joint molding of layers of different powders, it is known from published, German Pat. Application No. 3,305,875 to provide a synthetic resin-bonded compact for forming a wear-resisting facing and to place such compact into a mold, in which the compact is then molded and sintered together with a metal powder which has been charged into the mold and is intended to form the base of the molding to be made. Because the compact is bonded by a synthetic resin, that known process cannot be used to make molybdenum-containing, wear-resisting facing as the synthetic resin binder necessarily introduces carbon into the wear-resisting facing, which owing to the presence of such carbon will not have the desired properties.

SUMMARY OF THE INVENTION

It is an object of the invention to provide a process of making sintered moldings which have a molybdenum-containing wear-resisting facing that meets particularly high requirements as regards its resistance to wear and small manufacturing tolerances, and specifically meets such requirements to be met by rocker arms for actuating valves in internalcombustion engines.

The object set forth is accomplished in accordance with the invention in that the metal powder intended to form the wear-resisting facing is separately compacted to form a compact before the iron powder intended to form the base of the molding is charged into the mold, and the metal powder mixture intended to form the wear-resisting facing is compacted to form said compact in such a manner that a profile is impressed into that surface of the compact which is intended to contact the base of the molding.

The metal powder which is intended to form the wear-resisting facing may separately be compacted to form a compact in the common mold but is usually compacted outside that mold. That compaction can be controlled to provide a coherent compact, which is dimensionally stable and has a predetermined density. It has been found that even though the compact is not bonded by a synthetic resin its external shape will not be adversely affected when the common mold into which the compact has been placed is charged with the iron powder that is intended to form the base of the molding and when the two metal powder layers are jointly molded thereafter so that a mixing of the metal powders of the two layers at the interface between the compact and the metal powder layer that is intended to form the base of the molding will be precluded and a decrease of the wear resistance of the wear-resisting facing as a result of such mixing will be prevented. In the separate compacting of the powder that is intended to form the wear-resisting facing, different conditions of internal friction in the two metal powder layers can be taken into account so that a uniform density of both layers can be achieved.

Because the metal powder mixture which is intended to form the wear-resisting facing is separately compacted, the two metal layers cannot interdigitate to a large extent. For this reason, measures must be taken to ensure the required joint between the wear-resisting facing and the base of the sintered molding. This is accomplished in that the wear-resisting facing is formed on that surface which will contact the base of the sintered molding with a profile which promotes the interlock between the two parts of the compound molding.

In order to ensure an adequate interlock, the profile which is impressed in the surface of the compact should have a depth of at least 0.1 mm. The design of the profile will depend on the requirements to be met in a given case and may be selected in accordance therewith. If the surface of the compact is formed with elongate depressions extending in two directions, preferably at right angles to each other, there wil be no preferred direction for a transmission of shear stresses between the wear-resisting facing and the base of the sintered molding, as would be the case with monoaxial depressions.

If the carbon-free metal powder mixture that is intended to form the wear-resisting facing is compacted to form the compact outside the common mold for jointly molding the base and the wear-resisting facing of the sintered molding, the handling of the compact will be facilitated if the compact has been presintered at a temperature of e.g., about 700° C. so that the compact is coherent and its dimensional stability has been increased. Such presintering will be particularly recommendable if relatively thin wearresisting layers are to be made.

DETAILED DESCRIPTION OF THE PREFERRED EMBODIMENT

Figure 1:
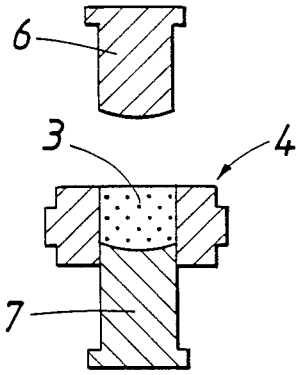
FIG. 1 is a diagrammatic transverse sectional view showing a mold that has been charged with a metal powder layer that is to be compacted in said mold to form a compact for forming a wear-resisting facing.
Figure 2:
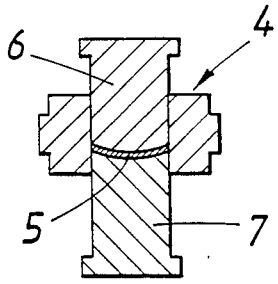
FIG. 2 shows that compacting mold after the punch has performed a compacting stroke.
Figure 3:
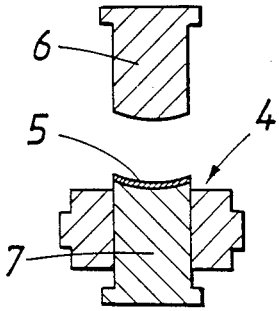
FIG. 3 shows the compacting mold in an ejecting position.
Figure 4:
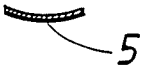
FIG. 4 is a transverse sectional view showing the compact.

A sintered molding, which has a base 1 and a molybdenum-containing wear-resisting facing 2 and constitutes, e.g., a rocker arm for actuating a valve of an internal combustion engine, is to be made under such conditions that the compacting of the metal powder for making the base 1 of the sintered molding will not adversely affect the quality of the wear-resisting facing. To that end the metal powder mixture 3 which is intended to form the wear-resisting facing is separately compacted in a separate compacting mold 4 to form a compact 5 as is indicated in FIGS. 1 to 3. The carbon-free metal powder mixture 3 used to form the wear-resisting facing 2, may be composed of, e.g., 65 to 80% by weight unalloyed iron particles and 35 to 20% by weight unalloyed molybdenum particles. By means of the punch 6 of the compacting mold 4 that metal powder mixture 3 is compacted to form a compact 5, which has a density that is at least 50% of the theoretical density of the powder mixture 3. To eject the compact 5, the die 7, which is associated with the punch 6, is moved away from said punch, as is shown in FIG. 3. Before the compact 5 is processed further, it may be presintered at about 700° C. Such presintering will not be required if the compact 5 has the dimensional stability which is required for a handling of the compact 5 and a coherence which is sufficient to prevent a mixing of the powder particles of the powder mixture 3 and the particles of the subsequently described iron powder 10 at the interface between the layers 3 and 10 when said layers are jointly molded to form a molding.

Figure 7:
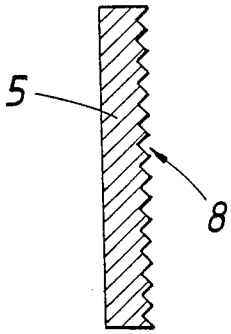
FIG. 7 is an enlarged sectional view taken on line VII—VII in FIG. 5.
Figure 5:
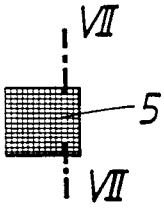
FIG. 5 is a top plan view on that surface of the compact which is intended to contact the base of the sintered molding.
Figure 6:
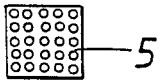
FIG. 6 is a view that is similar to FIG. 5 and shows a compact having a different surface shape.

A strong joint is required between the wear-resisting facing 2 and the base 1 of the sintered molding. To that end the compact 5 is formed on that surface which is intended to contact the base 1 of the sintered molding with a profile having a depth of at least 0.1 mm. The resulting profile 8 is impressed into that surface by means of the punch 6 and may desirably consist of grooves which are arranged in two sets, which intersect at right angles, as is apparent from FIGS. 5 and 7. Alternatively, the desired interlock between the base 1 of the sintered molding and the wear-resisting facing 2 may be ensured in that the profiled surface is formed with concave depressions arranged in rows which intersect each other.

Figure 8:
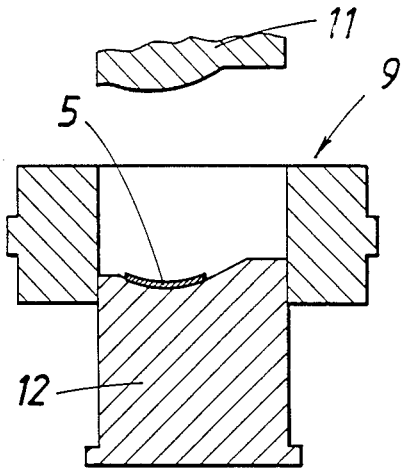
FIG. 8 is a diagrammatic transverse sectional view showing the common mold which contains the compact and is intended to jointly mold said compact and the iron powder for forming the base of the sintered molding.
Figure 9:
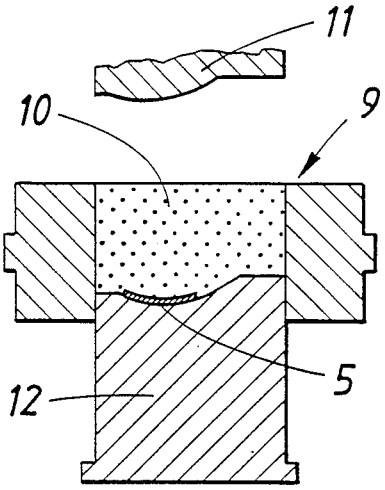
FIG. 9 is a view that is similar to FIG. 8 and shows the common mold which contains also the iron powder for forming the base of the sintered molding.
Figure 10:
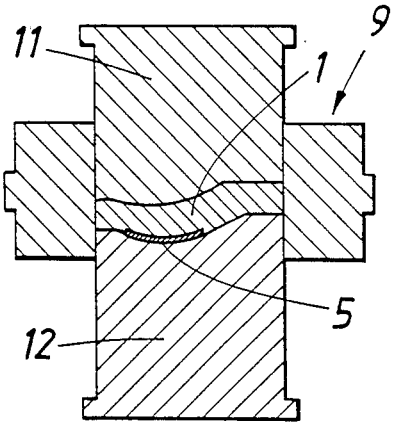
FIG. 10 shows the common mold after the molding of the two metal powder layers.
Figure 11:
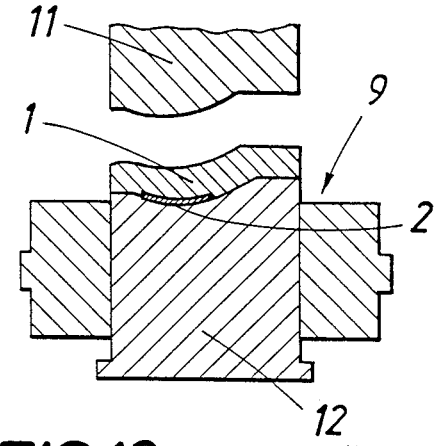
FIG. 11 shows the ejection of the molding.
Figure 12:
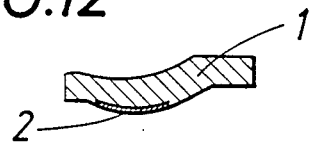
FIG. 12 is a transverse sectional view showing the finished sintered molding.

Thereafter the compact 5 is placed into a common mold 9 for jointly molding the wear-resisting facing and the body of the sintered molding, as is shown in FIG. 8. When the compact 5 has been placed into the mold 9, the latter is filled up with a low-alloy iron powder 10 so that the state illustrated in FIG. 9 is obtained. The compact 5 and the iron powder 10 are then jointly molded by means of the punch 11 under a pressure of at least 2,000 kg/cm$^2$ to form a molding, which is shown in FIG. 10. The resulting molding is subsequently presintered in the mold 9 and is thereafter sized under a pressure in excess of 2,000 kg/cm and finally sintered at a temperature up to 1350° C. The workpiece can then be ejected by means of the die 12, as is shown in FIG. 11.

The wear-resisting facing 2 may then be carburized on the endangered end face of the sintered molding 1 or may be hardened on that end face by a quenching and tempering treatment.

I claim:

1. In a process of making a sintered molding having a base and at least one molybdenum-containing, wear-resisting facing on said base, wherein a low-alloy iron powder intended to form said base and a carbon-free metal powder mixture intended to form said wear-resisting layer and consisting of unalloyed iron particles and unalloyed molybdenum particles are jointly molded to form a molding and said molding is subsequently sintered, the improvement residing in that said metal powder mixture is separately compacted to form a compact, which has a profiled surface having an impressed profile, and said compact in a coherent state and said iron powder in contact with said profiled surface are jointly molded to form said molding.

2. The improvement set forth in claim 1, wherein said metal powder mixture is separately compacted in a mold to form said compact, said iron powder is charged into said mold containing said compact, and said compact and said iron powder are jointly molded in said mold to form said molding.

3. The improvement set forth in claim 1, wherein said metal powder mixture is separately compacted in a first mold to form said compact, said compact is placed into a second mold, said iron powder is charged into said second mold containing said compact, and said compact and said iron powder are jointly molded in said second mold to form said molding.

4. The improvement set forth in claim 1, wherein said metal powder mixture is compacted to form said profiled surface with said impressed profile having a depth of at least 0.1 mm.

5. The improvement set forth in claim 1, wherein said metal powder mixture is compacted to form said compact in said profiled surface with impressed elongate depressions in two intersecting sets.

6. The improvements set forth in claim 5, wherein said sets intersect at right angles.

7. The improvement set forth in claim 1, wherein said compact is presintered to form a coherent compact before said iron powder is contacted with said profiled surface.

* * * * *